US006666740B1

(12) United States Patent
Schneider

(10) Patent No.: US 6,666,740 B1
(45) Date of Patent: Dec. 23, 2003

(54) STUFFED TOY WITH ATTACHED PACIFIER

(76) Inventor: Carla Schneider, 596 Cedar Gr., Orange, CT (US) 06477

( * ) Notice: Subject to any disclaimer, the term of this patent is extended or adjusted under 35 U.S.C. 154(b) by 207 days.

(21) Appl. No.: 09/264,294

(22) Filed: Mar. 8, 1999

(51) Int. Cl.[7] ..... A61J 17/00

(52) U.S. Cl. ..... 446/72; 446/369; 606/234; 606/236

(58) Field of Search ..... 446/72, 227, 369, 446/390; D24/195; 606/234, 235, 236

(56) References Cited

U.S. PATENT DOCUMENTS 4,188,747 A * 2/1980 Kramer
4,277,910 A * 7/1981 Kramer
D291,122 S * 7/1987 Grubb et al.
4,765,037 A * 8/1988 Perry
5,344,355 A * 9/1994 Silverstein ..... 446/72
5,534,014 A * 7/1996 Demeritt et al. ..... 606/236
5,593,336 A * 1/1997 Thomas ..... 446/81
5,624,090 A 4/1997 Gammelgaard
5,871,184 A 2/1999 Kaopio
D409,755 S * 5/1999 Thorpe et al. ..... D24/195
5,908,439 A * 6/1999 Ford et al. ..... 606/234

* cited by examiner

*Primary Examiner*—John A. Ricci
(74) *Attorney, Agent, or Firm*—Melvin I. Stoltz

(57) ABSTRACT

A stuffed toy in the shape of a small animal, such as a puppy, is attached to a silicone/polymeric pacifier of the type commonly provided for infants to suck on. The pacifier has at least one tab projecting from the side opposite to the nipple and for use in securing the toy to the pacifier.

22 Claims, 1 Drawing Sheet

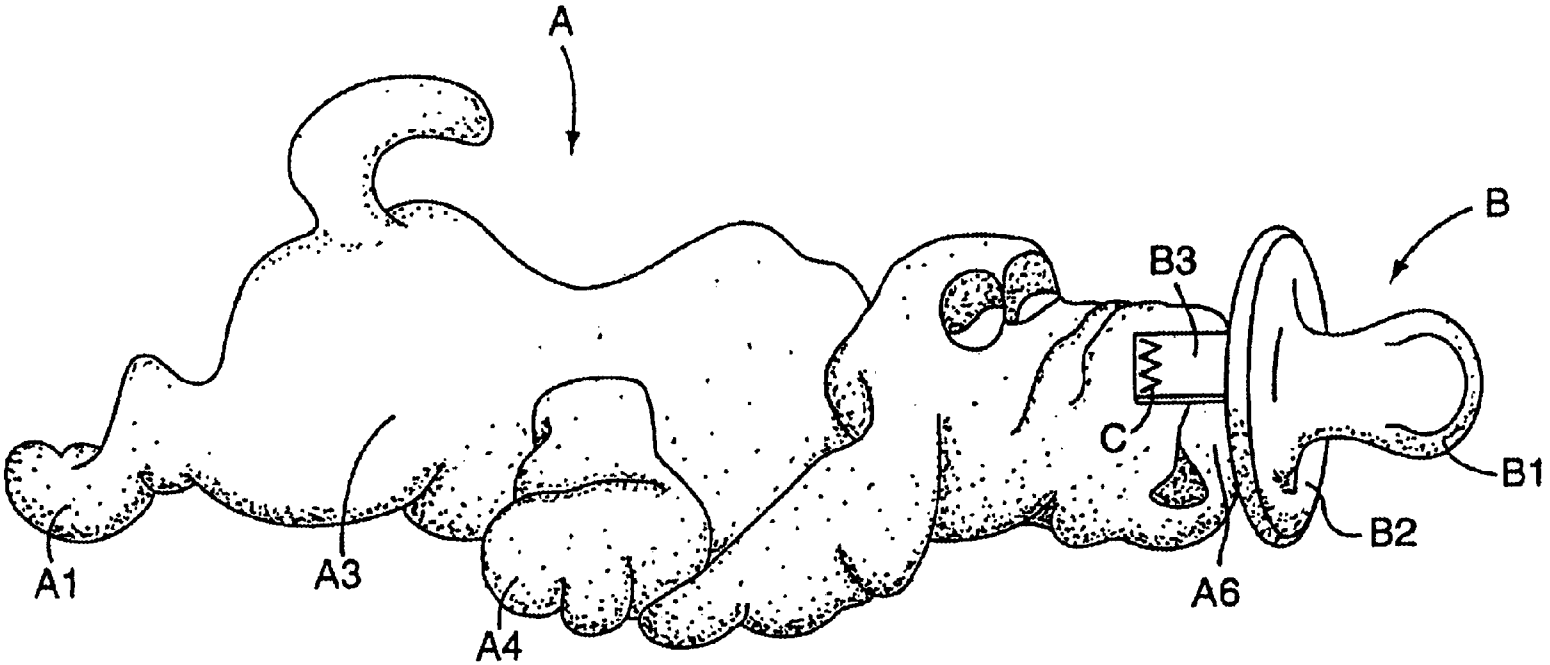
B
B1
B2
A6
B3
C
A
A4
A3
A1

STUFFED TOY WITH ATTACHED PACIFIER

FIELD OF THE INVENTION

This invention relates generally to a stuffed toy which may take the form of an animal or other geometric shape, and which has a nipple shaped pacifier attached to the toy, and more particularly attached to the head of the toy where the toy has the form of a stuffed animal.

SUMMARY OF THE INVENTION

The preferred form for an infant's toy and pacifier combination constructed in accordance with the present invention calls for the stuffed toy to include a readily deformable fabric envelope having at least one projecting portion, and including a filler inside the envelope to provide the toy with a variable three dimensional shape and configuration such as a typical stuffed toy of the type which is relatively soft to the touch and hence pliable enough for handling by a small child.

A pacifier which includes a nipple end for use by the child to pacify him or her also includes an annular flange to limit entry of the nipple end of the pacifier into the child's mouth.

The pacifier is preferably fabricated from a molded polymeric material, preferably containing silicone, and defines at least one tab on the side of the annular flange opposite the nipple.

Means is provided for securing this tab on the pacifier to the projecting portion of the stuffed toy.

Although, the envelope preferably has the shape of a mammal such as a four legged creature, and includes a head portion defining the aforementioned projecting portion which serves as the attachment point for the pacifier, it may also have other geometric shapes and need only define a projecting portion to which the tab of the pacifier is attached.

BRIEF DESCRIPTION OF THE DRAWING

The FIGURE is a three (3) dimensional view illustrating a stuffed toy constructed in accordance with the present invention and having a pacifier secured to a projecting portion thereof.

DETAILED DESCRIPTION

Turning now to the drawing in greater detail, a stuffed toy A is provided with a pacifier B such that the infant can readily pick up his stuffed toy and by orienting it in a pre-learned position, can bring the pacifier into his mouth such that the nipple portion (B1) can be used as a pacifier.

The stuffed toy A preferably has rear legs (A1) (only one shown) connected to a soft pliable body portion (A3), and may further include front legs or arms (A4) (only one shown) which are connected to the body portion (A3) as shown. A projecting portion (A6) of the body portion defines a head for the four-legged mammal creature or stuffed toy (A). The pacifier (B) includes the above-described nipple portion (B1), an annular flange portion (B2), and a tab illustrated at (B3) in FIG. 1.

This tab (B3) is adapted to be secured by suitable means to the projecting head portion (A6) of the pacifier B as for example by stitching as indicated generally at C.

As so constructed and arranged the stuffed toy with pacifier is easily located by an infant in his crib or playpen, and once located the pacifier can be used by the infant without the necessity for a baby-sitter or other person responsible for the care of a child to pick up and return it to the infant. Pacifiers are not normally connected to such a stuffed toy, but provided instead as a device with a ring or other protrusion small enough to allow the conventional pacifier to fall between the slats of the infant's play pen or crib for example. By connecting the pacifier to such a stuffed toy, the risks of the pacifier falling between the slats of the infant's play pen or crib are greatly reduced.

Various versions of the invention described above can be contemplated by the person skilled in the art. For example, the stuffed toy need not be in the form of a four-legged mammal, but might instead be in the form of a human, or may instead be in the form of some other geometric shape as for example a star shaped stuffed toy of the like. However, the present invention does require some sort of projecting portion (A6) of the stuffed toy which can be secured to the tab (B3) on a pacifier of the type which is molded from a polymeric material, preferably containing silicone, to have not only a nipple portion (B1) but also an annular ring or flange (B2) that will prevent the infant from swallowing the pacifier. Such pacifiers are sometimes provided with tabs such as shown in (B3) in order to provide a convenient anchor point for securing the pacifier to a plastic ring or the like.

What is claimed is:

1. An infant's toy and pacifier comprising:

a stuffed toy including a readily deformable fabric envelope defining at least one projecting portion, and said stuffed toy including a filler inside said envelope to provide said toy with a variable three dimensional shape and configuration, a pacifier attached to said stuffed toy by way of said projecting portion, wherein said pacifier includes a nipple end for pacifying an infant and an annular flange to limit entry of said pacifier into the infant's mouth, said pacifier being molded from a polymeric material and defining at least one tab on a side of said annular flange opposite said nipple, and means for fixedly securing said tab to said projecting portion of said stuffed toy envelope to prevent removal of said pacifier from said stuffed toy.

2. The infant's toy and pacifier of claim 1, said envelope having the shape of a mammal, and said projecting portion having the shape of the mammal's head.

3. The infant's toy and pacifier of claim 2, wherein said envelope further defines a plurality of legs.

4. The infant's toy and pacifier of claim 1, wherein the means for fixedly securing the tab to the projecting portion of the envelope comprises stitching.

5. The infant's toy and pacifier of claim 1, wherein the pacifier is molded in one-piece defining said nipple, said annular flange, and said at least one tab.

6. The infant's toy and pacifier of claim 1, said envelope having a geometric shape.

7. A combined pacifier and toy assembly constructed for use with infants and comprising:

A. a toy member comprising an elongated, generally rectangular shaped envelope defining a longitudinally extending central axis;

B. a pacifier member comprising a. an annular, substantially flat flange portion having a first surface and an opposed second surface, b. an elongated, axially extending nipple portion affixed to the first surface of the flange portion and extending substantially perpendicularly therefrom, and c. at least one tab extending from the second surface of the flange portion; and C. said pacifier member and said toy member being securely affixed to each other with the axis of the nipple portion of the pacifier member being maintained substantially parallel to the central axis of the toy member, with said nipple portion forming one end of said pacifier/toy assembly construction, whereby a generally elongated pacifier/toy assembly is created with the nipple portion forming one fixed, terminating end thereof.

8. The pacifier/toy assembly defined in claim 7, wherein said envelope is further defined as being formed from soft, deformable and pliable material.

9. The pacifier/toy assembly defined in claim 8, wherein said envelope is further defined as being stuffed.

10. The pacifier/toy assembly defined in claim 9, wherein said envelope comprises a three-dimensional shape.

11. The pacifier/toy assembly defined in claim 10, wherein said three-dimensional shape is further defined as comprising one selected from the group consisting of mammals and four-legged creatures.

12. The pacifier/toy assembly defined in claim 7, wherein said pacifier member is further defined as being securely affixed directly to the toy member by engagement of the tab of the pacifier member directly to the toy member.

13. The pacifier/toy assembly defined in claim 12, wherein said tab extends substantially perpendicularly from the second surface of the flange portion and said tab is affixed in its substantial entirety to the toy member, thereby positioning the flange portion in abutting engagement with the toy member.

14. The pacifier/toy assembly defined in claim 13, wherein the tab of the pacifier is further defined as being stitched directly to the toy member for providing if secure affixation thereto.

15. A combined pacifier and toy assembly constructed for use with infants and comprising:

A. a toy member comprising
   a. an elongated, readily deformable envelope, and
   b. at least one projecting portion integrally formed therewith and defining one end of said envelope;

B. a pacifier member comprising
   a. an annular, substantially flat flange portion having a first surface and an opposed second surface,
   b. an elongated, axially extending nipple portion affixed to the first surface of the flange portion and extending substantially perpendicularly therefrom, and
   c. at least one tab extending from the second surface of the flange portion; and C. said toy member and said pacifier member being securely mounted to each other by affixing the tab portion of the pacifier member directly to the projecting portion of the toy member in a manner which assures the nipple portion is maintained in substantial alignment with the central axis of the elongated, longitudinally extending envelope.

16. The pacifier/toy assembly defined in claim 15, wherein said envelope is further defined as being formed from soft, deformable and pliable material.

17. The pacifier/toy assembly defined in claim 16, wherein said envelope is further defined as being stuffed.

18. The pacifier/toy assembly defined in claim 17, wherein said envelope comprises a three-dimensional shape.

19. The pacifier/toy assembly defined in claim 18, wherein said three-dimensional shape is further defined as comprising one selected from the group consisting of mammals and four-legged creatures.

20. The pacifier/toy assembly defined in claim 19, wherein said tab is further defined as extending substantially perpendicularly from the second surface of the flange portion, and substantially parallel to the nipple portion, thereby maintaining the nipple portion in the desired position.

21. The pacifier/toy assembly defined in claim 20, wherein said tab portion is affixed in its substantial entirety to the projecting portion of the toy member, thereby causing the flange portion to be in abutting contact with the projecting portion.

22. A combined pacifier and toy assembly constructed for use with infants and comprising:

A. a toy member comprising an elongated, generally rectangular shaped envelope defining a longitudinally extending central axis, terminating with an integrally attached projecting portion, and said envelope comprising a three-dimensional shape comprising one selected from the group consisting of mammals and four-legged creatures;

B. a pacifier member comprising
   a. an annular, substantially flat flange portion having a first surface and an opposed second surface,
   b. an elongated, axially extending nipple portion affixed to the first surface of the flange portion and extending substantially perpendicularly therefrom, and
   c. at least one tab extending substantially perpendicularly from the second surface of the flange portion; and C. said pacifier member and said toy member being securely affixed to each other with the tab of the pacifier member being secured in its entirety to the projecting portion of the toy member, securing the flange portion in abutting engagement with the projecting portion and positioning the axis of the nipple portion of the pacifier member substantially parallel to the central axis of the toy member, with said nipple portion forming one end of said pacifier/toy assembly construction, whereby a generally elongated pacifier/toy assembly is created with the nipple portion forming one fixed, terminating end thereof.

* * * * *